US005615878A

United States Patent [19]

Belanger et al.

[11] Patent Number: 5,615,878

[45] Date of Patent: Apr. 1, 1997

[54] METHOD AND APPARATUS FOR ACCELERATING AND DIVERTING FLAT PRODUCTS

[75] Inventors: Roger R. Belanger, Dover; Michael A. Novick, New Durham, both of N.H.

[73] Assignees: Heidelberg Harris Inc., Dover, N.H.; Heidelberger Druckmaschinen AG, Heidelberg, Germany

[21] Appl. No.: 515,201

[22] Filed: Aug. 15, 1995

[51] Int. Cl.[6] ..... B65H 39/10

[52] U.S. Cl. ..... 271/302; 271/303; 271/315; 271/272; 198/440

[58] Field of Search ..... 271/272, 275, 271/67, 69, 70, 315, 302, 303; 198/440

[56] References Cited

U.S. PATENT DOCUMENTS

| | | | |
|---|---|---|---|
| 3,894,479 | 7/1975 | Anikanov et al. | 271/303 |
| 4,120,491 | 10/1978 | Lang | 271/303 |
| 4,373,713 | 2/1983 | Loebach | 271/303 |
| 4,729,282 | 3/1988 | Kasdorf | 271/303 |
| 4,948,112 | 8/1990 | Sato et al. | 270/60 |
| 5,112,033 | 5/1992 | Breton | 270/47 |

FOREIGN PATENT DOCUMENTS

| | | | |
|---|---|---|---|
| 0089407 | 9/1983 | European Pat. Off. | 271/303 |
| 0147762 | 6/1988 | Japan | 271/303 |
| 0147763 | 6/1988 | Japan | 271/303 |

*Primary Examiner*—H. Grant Skaggs

[57] ABSTRACT

The present invention is directed to an apparatus, such as a folder apparatus of a web-fed printing press, having a printed product delivery with two fan wheel arrangements overlapping each other. An exemplary embodiment includes a mechanism for continuously conveying flat products. The mechanism has devices attached thereto in a timed arrangement for positioning each flat product to be delivered, in its entirety, off a centerline of the fan wheel arrangements prior to the entry of the flat product into a pocket of the fan wheel arrangements.

20 Claims, 7 Drawing Sheets

Fig. 2
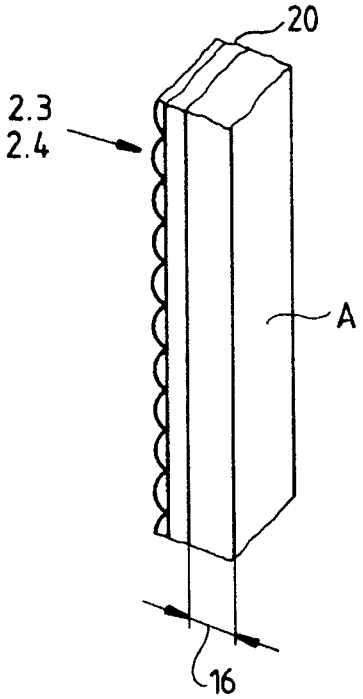
Fig.3
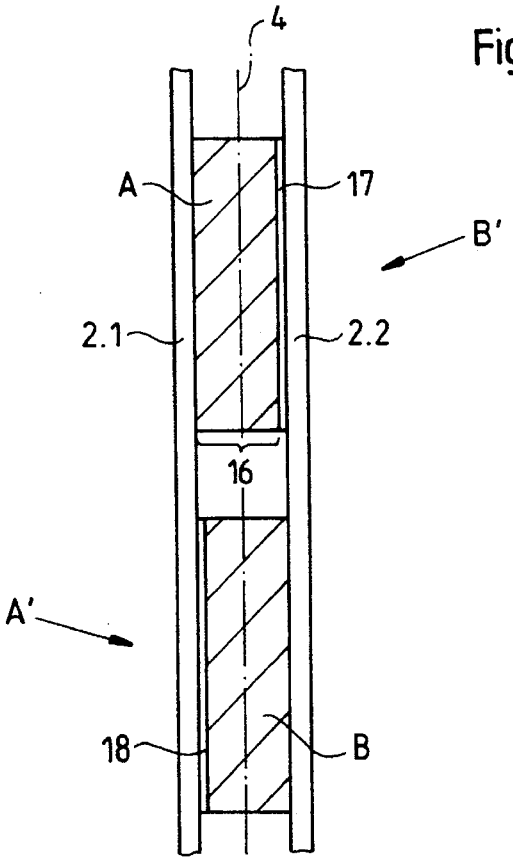
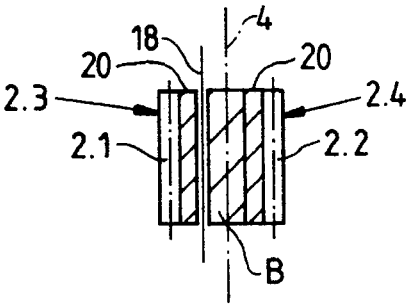
Fig. 4

2.1
12
2.2
4
B
12
13
5
5
A
12
9
10
13
8
11
10
10
12
13
17
11
4
10

METHOD AND APPARATUS FOR ACCELERATING AND DIVERTING FLAT PRODUCTS

BACKGROUND OF THE INVENTION

1. Field of the Invention

The present invention relates to a method and apparatus for accelerating and diverting flat products conveyed within, for example, a folding apparatus of a printing press.

2. State of the Art

U.S. Pat. No. 4,373,713 discloses a diverter mechanism. A sheet diverter is provided in the path of a stream of cut sheets which are to be diverted in a predetermined sequence in different directions. The sheet diverter includes a pair of rotary diverters having cam surfaces thereon which direct and guide the sheets in the predetermined sequence relative to a pair of guiding surfaces.

U.S. Pat. No. 4,948,112 discloses a folding machine in a rotary press. The folding machine is of the type in which a printed paper web is twice-folded and then cut into folded sheets by means of cutter drums. The folded sheets are conveyed through a distributor section on a downstream side of the folding machine to a pair of ejected paper sheet runners while being pinched by belts, or tapes. A conveyor for conveying the folded sheets includes a pair of first conveyor belts between the outlet side of the cutter drums, and an upstream side of the distributor section, a pair of distributor belts which form the distributor section with a triangular guide disposed on the downstream side thereof, two pairs of second conveyor belts between the downstream side of the distributor section and the inlet sides of the pair of ejected paper sheet runners, and guide belts or fixed guide members extending between a location upstream of the distributor section and the inlet side of the distributor section and between the outlet side of the distributor section and a location downstream of the distributor section. These belt pairs define, respectively, independent closed routes. The pair of distributor belts are respectively provided with uneven portions along their length adapted to mesh with each other. Preferably, the pair of distributor belts run at a higher speed than the pair of first conveyor belts, and the two pairs of second conveyor belts run at a higher speed than the pair of distributor belts.

U.S. Pat. No. 5,112,033 discloses a folder apparatus for a web-fed printing press. The folder apparatus includes a printed product delivery with two fan arrangements each of which is formed of a plurality of mutually adjacent fans spaced-apart from one another on a common axis, the respective common axis of each of the two fan arrangements being disposed parallel to the common axis of the other. Each of the fans of one of the fan arrangements is disposed adjacent to a respective common plane with a respective one of the fans of the other of the fan arrangements, each of the fans being formed with blades having tips located at a circumference of the respective fan, the circumferences of the fans and the respective common plane intersecting with one another. A device is provided on the fans for preventing a collision of respective blade tips of the fans disposed in the respective common plane.

A general disadvantage of the state of the art is that devices for accelerating and diverting flat products require a primary accelerating belt system, a diverting mechanism, a steeple (such as a triangular guide) and a secondary set of transport belts. Although there are untimed flat belts used for accelerating and transporting purposes, the foregoing patents disclose, with the exception of U.S. Pat. No. 5,112,033, to use timed, or synchronized, diverters in conjunction with sets of untimed high speed belts.

SUMMARY OF THE INVENTION

Having outlined the state of the art and its attendant disadvantages, an object of the present invention is to desensitize a product delivery apparatus to the exact timing typically required for entry of folded products into alternating fan wheel arrangements.

A further object of the present invention is to allow for a desired positioning of the flat products before entering respective fan pockets of the fan wheel arrangements.

Another object of the present invention is to achieve a lengthening of the time period for product positioning before the respective products enter respective fan pockets.

According to exemplary embodiments of the present invention, a folder apparatus of a web-fed printing press is provided for printed product delivery and comprises:

two fan wheel arrangements, overlapping each other;

a mechanism for continuously conveying flat products into said two fan wheel arrangements; and devices attached to said mechanism in a timed arrangement for positioning said flat products in their entirety off a centerline of said fan wheel arrangements prior to synchronized entry of said flat products into said fan wheel arrangements.

According to exemplary embodiments of the present invention, flat products can be repositioned according to respective positions of pockets in fan wheel arrangements which they are supposed to enter. A desired repositioning of flat products allows for higher accuracy of product delivery into the fan wheel pockets. Since the diverting operation is established prior to product entry, each product to enter a respective fan wheel pocket is prepared accordingly by being placed in the position to be delivered.

According to further embodiments of the present invention, a timed set of first belts, or tapes (that is, a set including one or more belts) has raised and non-raised portions spaced equally from one another over the surface of the set of belts. As referenced herein, the term "belts" will be used to collectively reference any type of belt, tape or other device, formed of any material, which can be used in conjunction with the transport of a flat product. In an exemplary embodiment of the present invention, a set of first timed belts cooperates, in synchronism, with a set of second timed belts provided with analogous raised and non-raised portions. Since corresponding raised and non-raised portions of said sets of belts cooperate with each other, flat products to be delivered are offset relative to one another in alternate directions during conveyance. In exemplary embodiments the raised and non-raised portions each have a length equal to or longer than the corresponding length of the flat products to be delivered.

A lead-in region of the apparatus can include a deflecting roller for either narrowing or broadening the lead-in region based upon production requirements.

The raised portions have a thickness by means of which a flat product transporting plane is penetrated, thereby allowing for offsetting flat products out of a centerline reference plane. The flat products to be delivered to the overlapping fan wheel arrangements are alternately offset to one side or the other of the centerline, thus establishing correct product transfer upon delivery to pockets of said fan wheel arrangements.

The number of non-raised and raised portions on the set of timed belts is not limited by two. For example, three or four or even more raised and non-raised portions can be established on the sets of belts. The number of raised and non-raised portions can, for example, be equal and a multiple of the number of products produced by the cutting cylinders. A further embodiment of the present invention includes an intermediate layer on surfaces of both sets of belts, the raised portions being molded thereon.

BRIEF DESCRIPTION OF THE DRAWINGS

The present invention, together with additional objects and advantages thereof, will be best understood from the following description of specific exemplary embodiments when read in connection with the accompanying drawings, in which:

FIGS. 2, 3, 4 schematically show an exemplary diverting offset to be established;

DETAILED DESCRIPTION OF PREFERRED EMBODIMENTS

Figure 1:
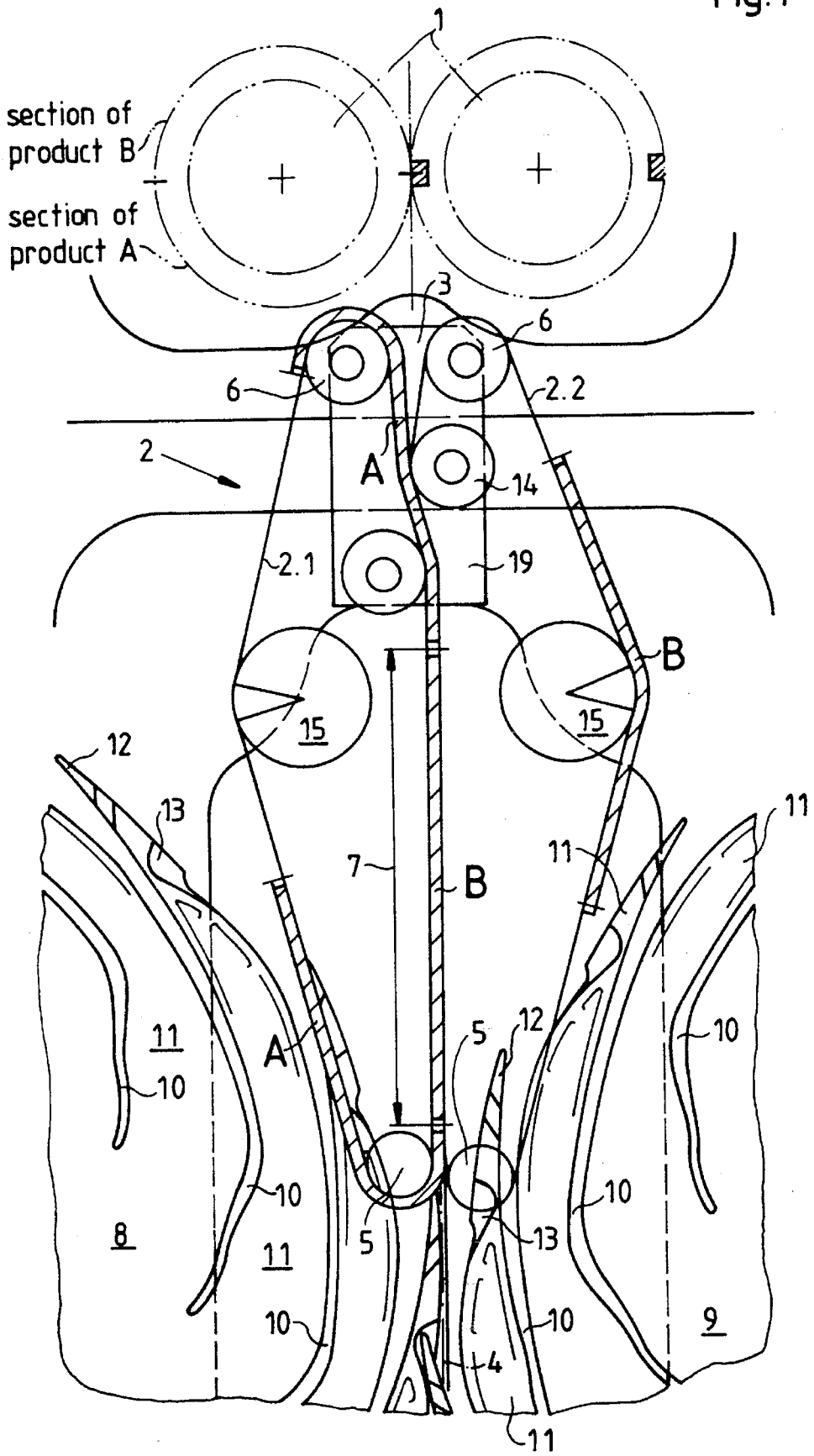
FIG. 1 is a side view of an exemplary embodiment according to the invention.

FIG. 1 shows a side view of an exemplary apparatus according to the present invention.

Single folded products are cut from a continuous stream and conveyed by means of a timed pair of cutting cylinders 1 into a lead-in region 3 of a mechanism 2 having a set of one or more first belts, or tapes, 2.1 and having a set of one or more second belts 2.2. These belts 2.1 and 2.2 are guided over rollers 5 and 6 respectively, thus conveying folded products into fan pockets 10 of two fan wheel arrangements 8, 9 overlapping each other. The fan wheel arrangements 8, 9 each have a plurality of fan blades 11. These fan blades 11 each comprise a fan blade tip 12 which dives, during rotation, into a recess 13 of a corresponding fan blade 11 of the opposite fan wheel arrangement.

The mechanism 2 having a set of first belts 2.1 and a set of second belts 2.2, further comprises pretensioning timed drive rollers 15 approximately in the middle of the belt path, and a deflection roller 14 for limiting the lead-in region 3 of the mechanism 2.

In an exemplary embodiment, each of the belts 2.1 or 2.2, respectively are operated synchronously, in timed relationship to one another and to the fan wheel arrangements, these belts having a number of raised portions and non-raised portions regularly spaced from each other on surfaces of the belts. As shown in greater detail in FIG. 5, on belts 2.1 there are two raised surfaces A spaced from each other by non-raised surfaces A'. Since belts 2.1 have two raised surfaces A, belts 2.2 consequently have two raised surfaces B being spaced from each other by two non-raised surfaces B'. Since the set of timed first and second belts 2.1 and 2.2 cooperate with each other, a raised surface A of belts 2.1 dives into a section represented as non-raised surface B' of belts 2.2 during simultaneous and synchronized movement of the sets of belts 2.1 and 2.2.

In an exemplary embodiment, each of the raised surfaces A, B respectively, has a length equal to or longer than the corresponding folded product length as indicated by reference numeral 7 (see FIG. 1). For example, where a product is on the order of 11.375 inches, the surfaces A, A', B, B' can be used to form diverting offsets of 12.375 inches in length (that is, one inch longer than the product). Of course, any lengths of product and diverting offsets can be used, as can any relative differences in length between the product and the diverting offsets. In an exemplary embodiment, the length of the non-raised portions A', B' of the sets of belts 2.1 and 2.2 corresponds to the length of the raised surface portions A, B. Between the fan wheel arrangements 8, 9 there is defined a centerline 4, which describes a reference position—a theoretical plane in which flat folded products 17, 18 are to be conveyed.

In FIGS. 2–4 there is schematically illustrated what is accomplished by the raised and non-raised surface portions A, B, A', B' of the sets of belts 2.1 and 2.2. In FIG. 2 for instance, a raised surface portion A is shown to cause a diverting offset 16. With regard to FIG. 3 it becomes clear what is meant by an exemplary embodiment of a diverting offset 16: The raised portion A affixed to the first belt 2.1 offsets a flat product 17 out of the centerline 4 against the second belt 2.2. As schematically shown in FIG. 3, a flat product 18 is offset out of the centerline 4 by a raised portion B against a non-raised portion A' on the first belt 2.1. In accordance with exemplary embodiments, a flat product can be positioned by a distance ranging from plus or minus 0.125 inches to plus or minus 0.375 inches, or any other distance depending on geometry and manufacturing constraints, to thereby minimize and/or eliminate impacting a tail end of a flat product with the fan blade. Thus, a diverting of every other flat product 17, 18 from a preceding product is accomplished prior to entry of the flat product 17, 18 into the pockets 10 of the fan wheel arrangements 8, 9, respectively. The diverting offset 16 is defined as being the thickness of the raised portions A, B respectively. The true positioning of the flat products 17, 18 against the first and second belts 2.1 and 2.2 respectively is, in an exemplary embodiment, one half of the diverting offset 16 relative to the centerline 4 as shown in FIGS. 3 and 4, or any other distance.

FIG. 4 shows an embodiment of raised and non-raised portions on the first and second belts 2.1 and 2.2 having an intermediate layer 20 affixed to first and second timing belts 2.3 and 2.4 which serve as said first and second belts, respectively. The raised surface B diverts the flat product 18 by about an amount of thickness exceeding the conveying plane, i.e. centerline 4. Alternately, the intermediate layers can be integrally formed with the timing belts and therefore considered to constitute the timing belts. It will be appreciated that any number of intermediate layers can be used to modify the diverting offset.

Figure 5:
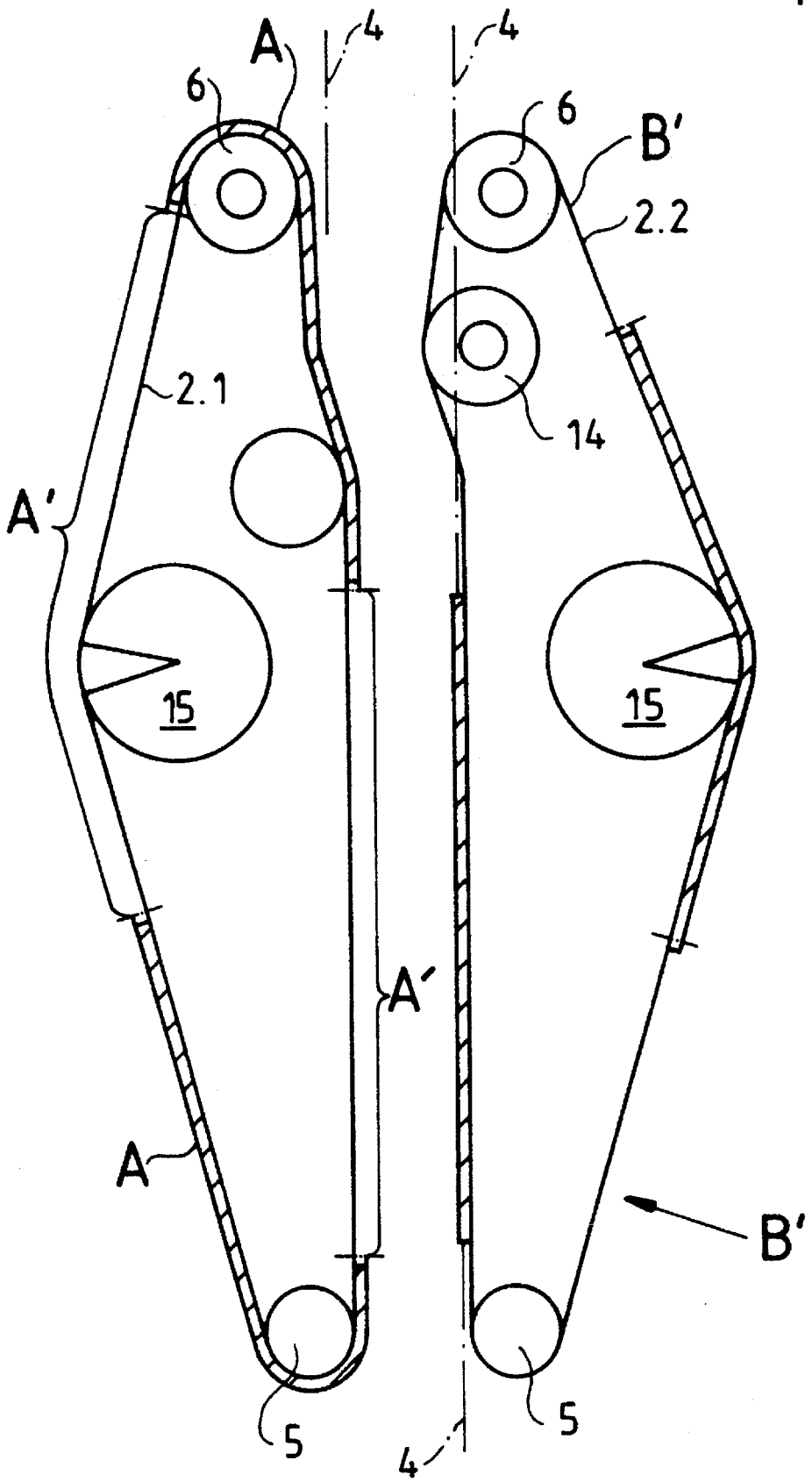
FIG. 5 shows the exemplary embodiment being divided along a centerline of two fan wheel arrangements.

In FIG. 5 there is shown an exemplary embodiment of the mechanism shown in FIG. 1, but in greater detail, wherein both sets of belts are separated from each other.

Upon common conveying of both sets of belts 2.1 and 2.2 respectively, their raised portions A, B and their non-raised portions A', B' cooperate with each other. The raised portions A, B mesh with the non-raised portions A', B' of the sets of belts 2.1 and 2.2. Thus, a diverting of flat products 17, 18 within a contacting area, (that is, the conveying plane along centerline 4) is established.

As shown in FIG. 5, upon conveying the sets of belts 2.1 and 2.2, the sets of belts rotate around rollers 5 and 6 which are tensioned by a pair of pretensioning timed drive rollers 15. A deflecting roller 14 is assigned to the sets of belts 2.2 to limit the product lead-in section 3. In an alternate embodiment, the deflecting roller 14 can be provided within the path of the first sets of belts 2.1, taking into consideration production and retrofitting requirements.

Figure 6:
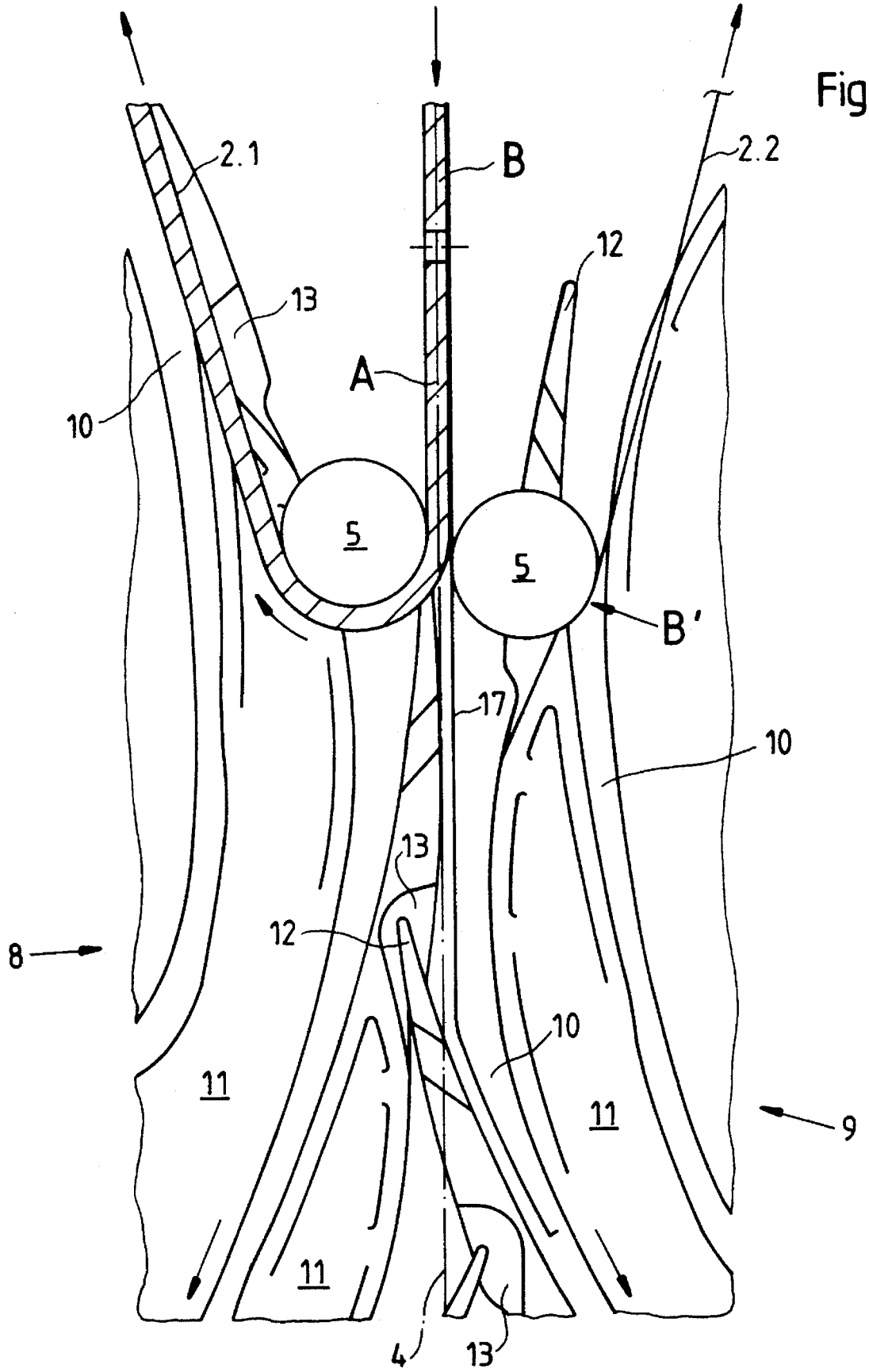
FIG. 6 shows a product entry of a first flat product being offset from a centerline into a respective fan wheel pocket.

FIG. 6 illustrates in greater detail a synchronized conveying of a flat product into pockets of fan wheel arrangements.

A raised portion A assigned to the set of first belts 2.1 cooperates with a non-raised portion B' of the second belt 2.2. A flat product 17 thus is offset to the righthand side of the centerline 4 in FIG. 6, defining a product conveying plane for reference purposes between the two fan wheel arrangements 8 and 9 partially shown in FIG. 6. As can be seen in FIG. 6, the flat product 17 enters a pocket 10 of the second fan wheel arrangement 9. One of the fan blade tips 12 of the second fan arrangement 9 which receives the flat product 17 is shown in FIG. 6 to have dove into a recess 13 of a corresponding fan blade 11 of the fan wheel arrangement 8. The leading edge of the flat product 17 has now entered a pocket 10 while the trailing edge of the flat product 17 is still being seized between the raised portion A of the set of first belts 2.1 and the non-raised portions B' on the set of second belts 2.2. Upon further rotation of the first and second fan wheel arrangements 8, 9 respectively, the flat product 17 is further urged out of the centerline 4 (see FIGS. 7 and 8).

Figure 7:
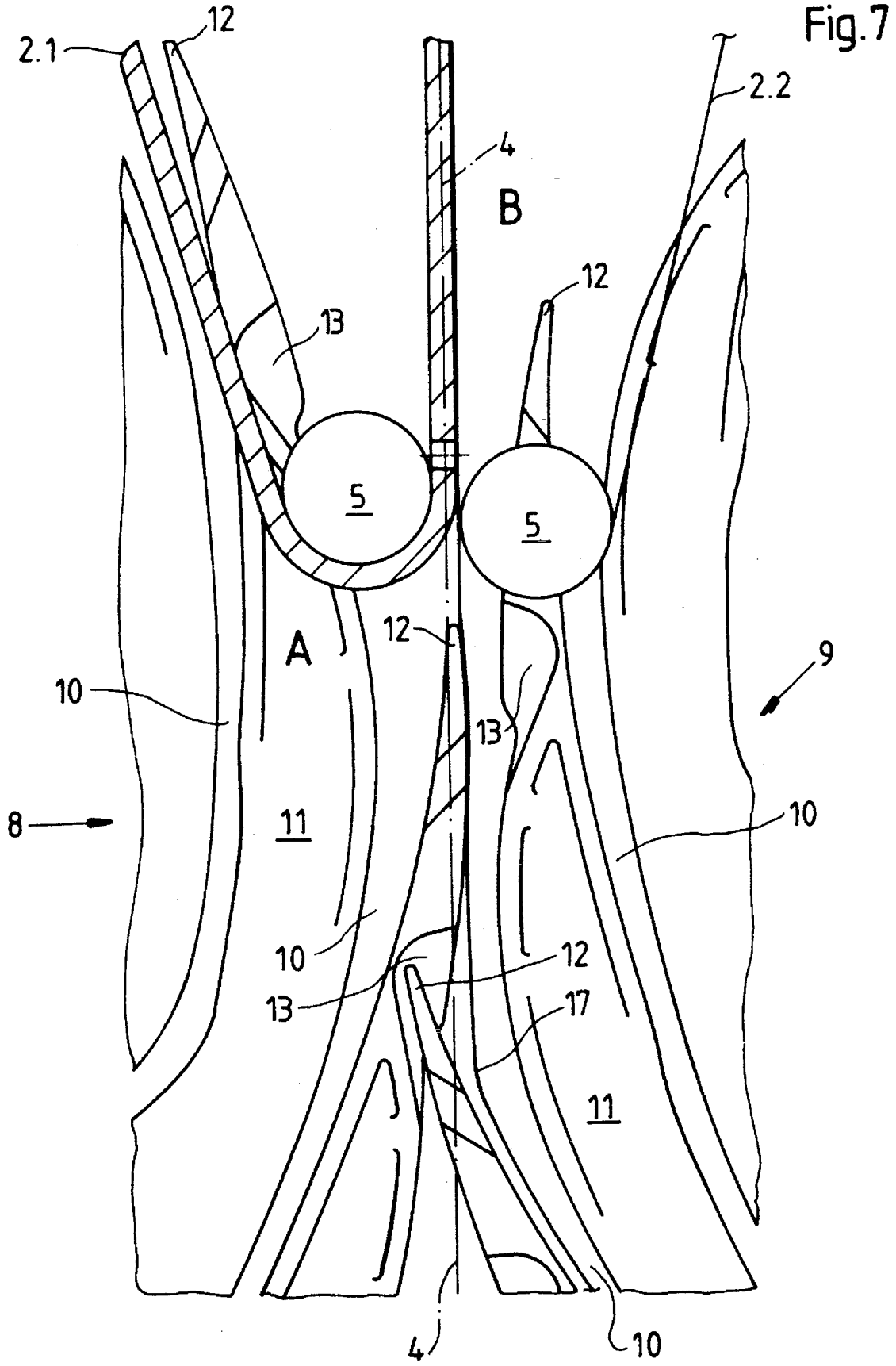
FIG. 7 shows an end of a first flat product having almost fully entered a pocket being deflected by a fan blade tip.

In FIG. 7 a further conveying stage is given. A trailing edge of the flat product 17 is about to be released by the raised portion A of the first set of belts 2.1 and a corresponding non-raised portion B' of the set of second belts 2.2. The flat product 17 has entered a pocket 10 between two fan blades 11, one of which includes the fan blade tip 12 which dove into the recess 13 of a corresponding fan blade 11 in the first fan wheel arrangement 8. The corresponding fan blade 11 of the first wheel arrangement 8 urges, upon further rotational movement thereof, the flat product 17 about to be released closer towards the second fan wheel arrangement 9. To prevent a collision between the fan wheels, the fan blades 11 of the second fan wheel arrangement 9, like the fan blades 11 of the first fan wheel arrangement 9, have a recess 13 for receiving a respective fan blade tip 12 of a fan blade 11.

Figure 8:
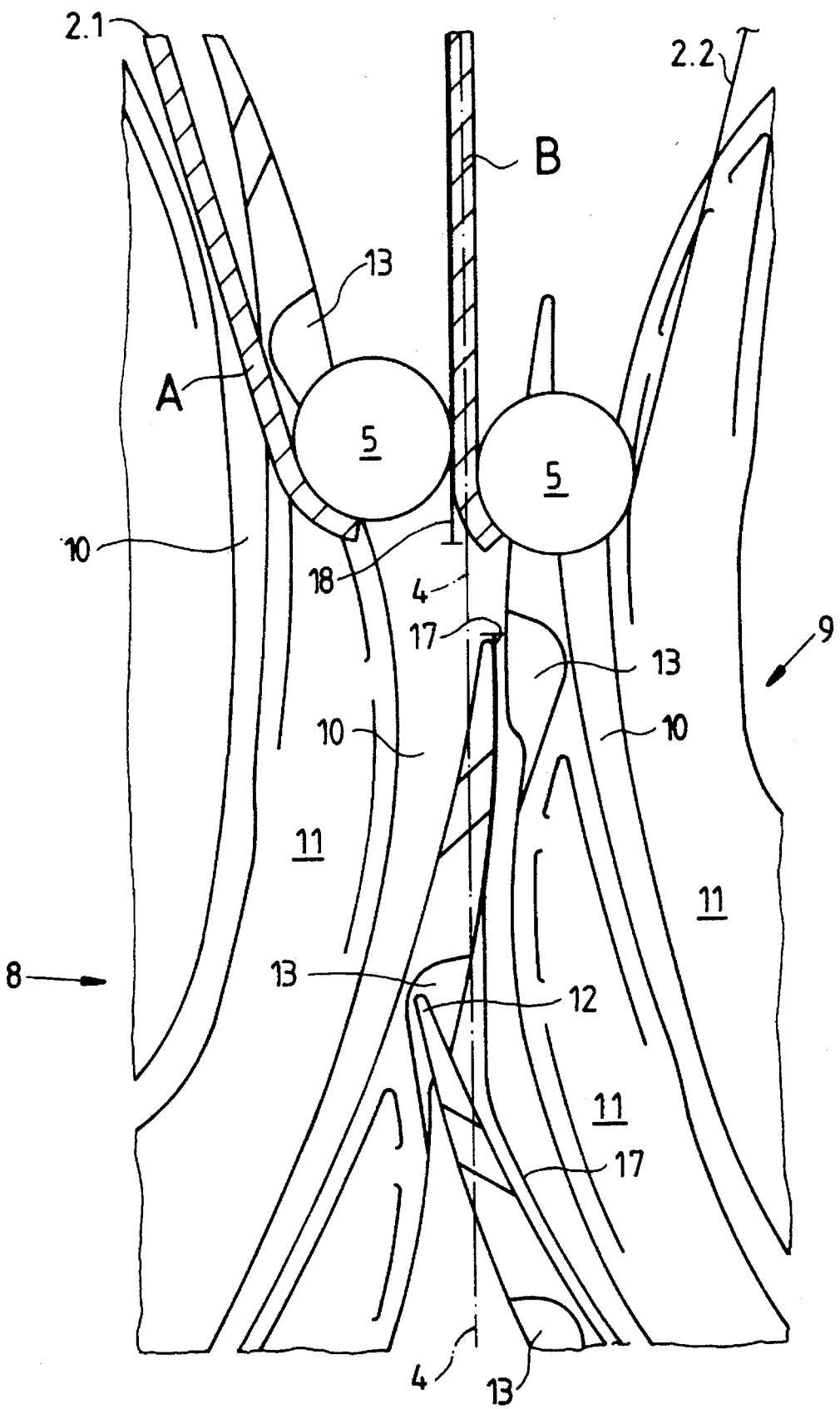
FIG. 8 shows a change in diverting offset upon delivery of a second flat product being seized by a raised surface B of the exemplary apparatus.

FIG. 8 shows a conveying stage wherein a flat product is released by the mechanism.

The flat product 17 entering a pocket 10 between two adjacent fan blades 11 of the second fan wheel arrangement 9 is urged out of the centerline 4 between the two fan wheel arrangements 8 and 9, respectively. Simultaneously, a flat product 18 offset from the centerline 4 to the lefthand side is conveyed into a pocket 10 of the first fan wheel arrangement 8. The flat product 18 is seized between a raised portion B of the set of second belts 2.2 and a non-raised portion A' of the first set of belts 2.1.

As shown in FIG. 8, the flat product 17 is offset to the righthand side of the centerline about one half of the diverting offset 16, and enters a pocket 10 of the second fan wheel arrangement 9. A subsequent flat product 18, offset to the lefthand side of the centerline 4 by about one half of the diverting offset 16, is shown in FIG. 8 at a position where it is about to enter a pocket 10 of the first fan wheel arrangement 8. Thus, by establishing a diverting offset into the mechanism 2 prior to the entry of flat products 17, 18 into pockets 10 of the fan wheel arrangements 8, 9 respectively, each product is prepositioned according to which fan wheel arrangement 8, 9 respectively, it is finally assigned.

As can be understood from the FIG. 8 example, the flat product 17 has completely left the centerline region so that any interference with the following flat product 18 is unlikely. The flat product 18 is therefore directed closer to a fan pocket 10 of the first fan wheel arrangement 8 into which it is supposed to enter.

Figure 9:
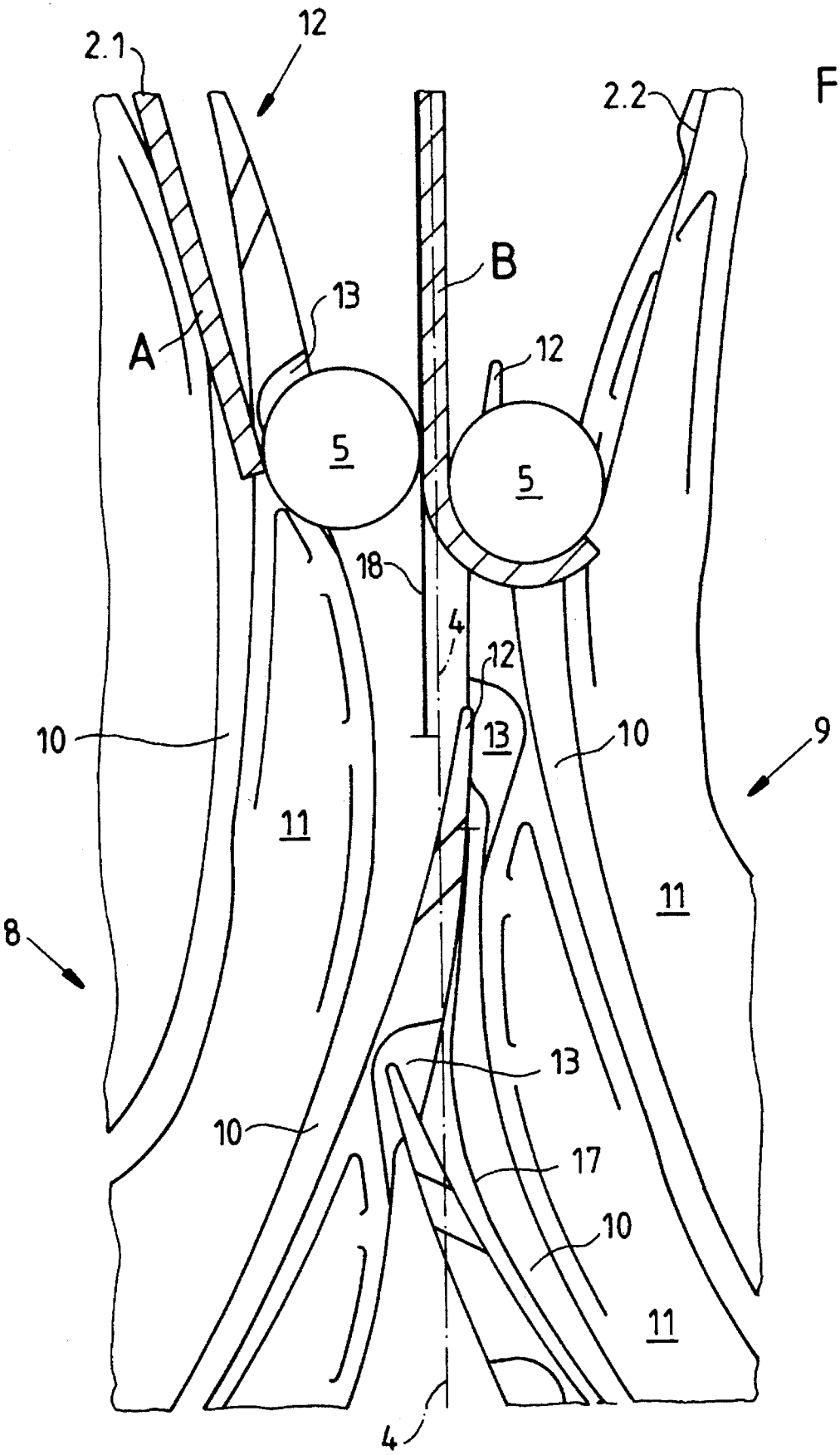
FIG. 9 shows the second flat product being guided into a respective fan pocket of a fan wheel.

FIG. 9 shows a flat product 18 further conveyed into a pocket 10 of the first fan wheel arrangement 8. Having conveyed the flat product 17 completely out of the centerline 4 region, a leading edge of the following flat product 18 is conveyed into the entry region of the corresponding first fan wheel arrangement 8.

By having assigned raised and non-raised flat portions to the sets of timed first and second belts 2.1 and 2.2 respectively, a diverting of the products to respective sides of the centerline 4 between two timed fan wheel arrangements 8, 9 respectively can be achieved without the use of a diverter steeple causing relative movement between respective flat products 17, 18 and the steeple itself. By means of the raised surfaces A, B assigned to the sets of timed belts 2.1 and 2.2, relative speeds between flat products 17, 18 and the raised surfaces A, B do not occur which would cause marking of the flat products 17, 18. Furthermore, by diverting the flat products 17, 18 prior to delivery into the pockets 10, contact of the flat products with the fan blade tips 12 of the first and second fan wheel arrangements 8, 9, respectively is minimized, thereby reducing excessive fan tip wear. In addition, the product delivery apparatus is desensitized to product-to-fan timing due to the diverting of the product during product delivery, thereby reducing the potential for product jams.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Apparatus for product delivery comprising:

two fan wheel arrangements overlapping each other;

a mechanism for conveying a flat product into said two fan wheel arrangements; and devices attached to said mechanism in a timed arrangement for positioning said flat product in its entirety, off a centerline of said fan wheel arrangements, prior to entry of the flat product in a pocket of said fan wheel arrangements.

2. Apparatus according to claim 1, wherein said mechanism further includes:

a set of first belts having raised portions and non-raised portions.

3. Apparatus according to claim 2, wherein said mechanism further includes:

a set of second belts having raised portions and non-raised portions.

4. Apparatus according to claim 3, wherein said raised portions of said set of first belts cooperate with said non-raised portions of said set of second belts.

5. Apparatus according to claim 4, wherein each of said raised portions of said set of first belts cooperates with said non-raised portions of said set of second belts, and each of said raised portions of said set of second belts cooperates with said non-raised portions of said set of first belts.

6. Apparatus according to claim 3 wherein said sets of first and second belts of said mechanism each further include:

an intermediate layer.

7. Apparatus according to claim 6, wherein said intermediate layer is formed as a surface of said non-raised portions of said sets of first and second belts.

8. Apparatus according to claim 6, wherein said raised portions are affixed to said intermediate layer on said sets of first and second belts.

9. Apparatus according to claim 6, wherein said intermediate layer is affixed to first and second timing belts which serve as said sets of first and second belts, respectively.

10. Apparatus according to claim 6, wherein said intermediate layer is integrally formed as part of each of said first and second timing belts.

11. Apparatus according to claims 2, wherein a length of said raised portions and a length of said non-raised portions are at least equal to a length of said flat product.

12. Apparatus according to claim 2, wherein said raised portions have a thickness which establishes a diverting offset.

13. Apparatus according to claim 12, wherein said mechanism conveys a plurality of flat products, a first of said plurality of flat products being offset by about one half of said diverting offset relative to said centerline of said fan wheel arrangement.

14. Apparatus according to claim 13, wherein said first of said plurality of flat products is offset to one side of said centerline of said fan wheel arrangement.

15. Apparatus according to claim 14, wherein said second of said plurality of flat products is offset to another side of said centerline of said fan wheel arrangement.

16. Apparatus according to claim 14, wherein a second of said plurality of flat products is offset by about one half of said diverting offset to another side of said centerline which is opposite said first side.

17. Apparatus according to claim 2, wherein a number of said raised portions is equal to a number of non-raised portions.

18. Apparatus according to claim 1, wherein said mechanism further includes:

a lead-in section which is adjusted by a deflecting roller.

19. Method for product delivery comprising the steps of:

positioning a flat product, in its entirety, off a centerline between overlapping fan wheels of a fan wheel arrangement; and conveying a flat product into said overlapping fan wheels in synchronism with rotation of said overlapping fan wheels.

20. Method according to claim 19, further comprising a step of:

conveying said flat product using sets of first and second belts, each of said sets of first and second belts each having raised and non-raised portions, wherein each of said raised portions of said set of first belts cooperates with said non-raised portions of said set of second belts, and each of said raised portions of said set of second belts cooperates with said non-raised portions said set of second belts.

* * * * *